US011191307B2

(12) United States Patent
Geraghty

(10) Patent No.: US 11,191,307 B2
(45) Date of Patent: Dec. 7, 2021

(54) ARTICLE OF INFANT CLOTHING

(71) Applicant: NeoNesh Group, LLC, Londonderry, NH (US)

(72) Inventor: Scott P. Geraghty, Londonderry, NH (US)

(73) Assignee: NeoNesh Group, Inc., Londonderry, NH (US)

( * ) Notice: Subject to any disclaimer, the term of this patent is extended or adjusted under 35 U.S.C. 154(b) by 0 days.

(21) Appl. No.: 16/353,761

(22) Filed: Mar. 14, 2019

(65) Prior Publication Data

US 2019/0208832 A1 Jul. 11, 2019

Related U.S. Application Data

(63) Continuation-in-part of application No. 15/700,321, filed on Sep. 11, 2017, now abandoned.

(60) Provisional application No. 62/393,969, filed on Sep. 13, 2016, provisional application No. 62/642,952, filed on Mar. 14, 2018.

(51) Int. Cl.
*A41B 13/06* (2006.01)
*A41D 13/12* (2006.01)

(52) U.S. Cl.
CPC ..... *A41B 13/06* (2013.01); *A41D 13/1272* (2013.01); *A41B 2300/322* (2013.01)

(58) Field of Classification Search
CPC ..... A41D 13/1281; A41D 13/1272; A41D 2400/10; A41D 2400/482; A41B 13/06; A41B 13/005; A41B 2300/32
USPC ..... 2/69.5
See application file for complete search history.

(56) References Cited

U.S. PATENT DOCUMENTS 4,688,270 A 8/1987 Denicola et al.
7,181,773 B1 * 2/2007 Piraka ..... A41D 13/1281 2/114
7,537,284 B1 * 5/2009 Antorcha ..... B60N 2/2881 297/219.12

(Continued)

FOREIGN PATENT DOCUMENTS

WO 2008150183 12/2008

OTHER PUBLICATIONS

RF SOLL, Heat loss prevention in neonates, Journal of Perinatology, 2008, 28, S57-S59.

(Continued)

*Primary Examiner* — Alissa L Hoey
*Assistant Examiner* — Patrick J. Lynch
(74) *Attorney, Agent, or Firm* — Michael J. Gallagher; Grossman, Tucker, Perreault & Pfleger PLLC

(57) ABSTRACT

An article of clothing, comprising an infant clothing pod configured to contain an infant, the infant having a birth weight in a range of 1 pound to 11 pounds; the infant clothing pod having a cavity configured to contain upper appendages, lower appendages and torso of the infant, wherein the upper appendages comprise a left arm and a right arm, and the lower appendages comprise a left leg and a right leg; the infant pod having an openable and closeable infant ingress-egress aperture extending longitudinally along a length of the pod; and the infant pod having an anterior sub-torso aperture and a posterior sub-torso aperture which are positioned to be located between the left leg and the right leg of the infant.

20 Claims, 9 Drawing Sheets

(56) References Cited

U.S. PATENT DOCUMENTS

| | | | | |
|---|---|---|---|---|
| 7,810,172 | B2 * | 10/2010 | Williams | A41D 13/1272 2/114 |
| 8,690,835 | B1 * | 4/2014 | Parris | A41D 13/1236 604/174 |
| 8,832,864 | B1 * | 9/2014 | Braden | A41D 13/1272 2/80 |
| D718,017 | S | 11/2014 | Barski | |
| D728,198 | S | 5/2015 | Barski | |
| D728,199 | S | 5/2015 | Barski | |
| D734,592 | S | 7/2015 | Castillo et al. | |
| D776,900 | S | 1/2017 | Bopanna et al. | |
| D790,803 | S | 7/2017 | Paperno | |
| 2006/0006710 | A1 * | 1/2006 | Sallus | B60N 2/60 297/219.12 |
| 2006/0138826 | A1 * | 6/2006 | Caton | A47D 13/02 297/256.16 |
| 2009/0256411 | A1 * | 10/2009 | Vallowe | G09F 3/20 297/482 |
| 2010/0242150 | A1 | 9/2010 | Trouillot | |
| 2012/0078190 | A1 | 3/2012 | Austin | |
| 2012/0151654 | A1 | 6/2012 | Chopak et al. | |
| 2013/0104279 | A1 | 5/2013 | Galli, Jr. et al. | |
| 2013/0139290 | A1 | 6/2013 | Barski | |
| 2014/0259272 | A1 | 9/2014 | Kiernan | |
| 2015/0128350 | A1 | 5/2015 | Paperno | |
| 2015/0374048 | A1 | 12/2015 | Theodossiou | |
| 2016/0050995 | A1 | 2/2016 | Bentley et al. | |
| 2017/0311663 | A1 | 11/2017 | Wollschlaeger et al. | |
| 2018/0199638 | A1 | 7/2018 | Byrne | |
| 2018/0228222 | A1 | 8/2018 | Barski et al. | |
| 2020/0046034 | A1 * | 2/2020 | Stamm | A41B 13/06 |

OTHER PUBLICATIONS

Office Action dated Apr. 2, 2019, issued in U.S. Appl. No. 15/700,321, 18 pages.

* cited by examiner

| | 0(Points) | 1 | 2 |
|---|---|---|---|
| Appearance | Blue or pale all over | Blue extremities, but torso pink | Pink all over |
| Pulse | None | <100 | >100 |
| Grimace | No response | Weak grimace when stimulated | Cries or pulls away when stimulated |
| Activity | None | Some flexion of arms | Arms flexed, legs resist extension |
| Respirations | None | Weak, irregular or gasping | Strong cry |

ARTICLE OF INFANT CLOTHING

CROSS-REFERENCE TO RELATED APPLICATIONS

This application is a continuation-in-part of U.S. patent application Ser. No. 15/700,321, filed Sep. 11, 2017, which claims the benefit of U.S. provisional patent application Ser. No. 62/393,969, filed Sep. 13, 2016. This application also claims the benefit of U.S. provisional patent application Ser. No. 62/642,952, filed Mar. 14, 2018. All the foregoing applications are incorporated by reference herein in their entirety.

FIELD

The present disclosure relates to an article of clothing, and more particularly a clothing pod for a human infant.

BACKGROUND

As reported by Roger F. Soll, "Heat Loss Prevention in Neonates" (Journal of Perinatology (2008) 28, S57-S59), if not adequately attended to, a newborn infant may experience hypothermia and cold stress. Infants exposed to cold temperatures are at risk for increased mortality. The normal temperature range for a neonate is 36.5 to 37.7° C. Cold stress may occur when an infant's temperature drops to 36.0° C. Temperatures below 36° C. are considered hypothermic. Moderate hypothermia is considered to be between 32 and 36° C. Severe hypothermia is considered when the infant's temperature is less 32° C.

As also reported by Soll, hypothermia results in a variety of physiologic stresses. The newborn infant has increased oxygen consumption, metabolic acidosis, hypoglycemia, decreased cardiac output and increased peripheral vascular resistance. Such medical conditions may be exacerbated in extremely low birth weight (ELBW) infants, which often need to be admitted to neonatal intensive care units (NICUs) with temperatures that would be considered hypothermic.

While delivery of an infant in a medical clinic may reduce the likelihood of the infant experiencing hypothermia and cold stress, newborn infants, including extremely low birth weight (ELBW) infants, may have to be delivered in the field (i.e. outside of a medical clinic), such as by an emergency medical technician (EMT), due to an emergency situation. In such situations, a newborn infant may be born in less than ideal conditions and far more likely to experience hypothermia and cold stress, particularly as EMTs in the field may not have access to heated incubators (isolette), radiant heat lamps, warming mattresses or other methods to warm a newborn infant.

For example, following birth in the field, a newborn infant often merely wrapped in one or more blankets as opposed to use of warming devices in a clinic. Thus, in the field, the newborn may not be warmed by an external heating device and may have to rely upon his/her own body temperature regulation. Such may be exacerbated by the blankets being wrapped rather loosely, particularly to permit access for taking vital signs (e.g. heart rate, temperature) or to administer medical treatment, such as an intravenous fluid. Moreover, such blankets make securing the newborn infant in a child seat for transportation to a medical clinic difficult.

However, even in a clinic, after birth, cleaning and initial examination, an infant is often repeatedly near completely unwrapped for diaper changes and follow-up examinations and be nearly fully exposed to a cold environment once again.

What is needed is an article of clothing for a newborn infant, which will keep the newborn infant born in the field warm while enabling medical personnel to examine the infant and administer medical treatment without having to expose the infant. Furthermore, the article of clothing should also be suitable for use to transport the newborn in a child seat to a medical clinic.

SUMMARY

The present disclosure provides an article of clothing particularly for a newborn infant to assist the infant in better regulating their body temperature. Newborn infants may lose body heat through heat transfer mechanisms such as radiation, conduction, convection and evaporation. The article of clothing disclosed herein is configured to enclose the infant therein to simulate the mother's womb, particularly to reduce heat loss through one or more of the foregoing heat transfer mechanisms.

In at least one embodiment of the present disclosure, an article of clothing may be provided comprising an infant clothing pod configured to contain an infant, the infant having a birth weight in a range of 1 pound to 11 pounds; the infant clothing pod having a cavity configured to contain arms, legs and torso of the infant; the infant pod having an openable and closeable infant ingress-egress aperture extending longitudinally along a length of the pod; and the infant pod having at least one of an anterior torso aperture and a posterior torso aperture.

In at least one embodiment of the present disclosure a method of providing at least one of medical diagnosis and treatment to an infant may be provided, comprising placing an infant having a weight in a range of 1 to 11 pounds in a cavity of an infant clothing pod configured to contain arms, legs and torso of the infant, wherein the infant pod has an openable and closeable infant ingress-egress aperture extending longitudinally along a length of the pod, and wherein the infant pod has at least one of an anterior torso aperture and a posterior torso aperture; at least partially closing the infant ingress-egress aperture; and placing a first medical device through the anterior torso aperture or posterior torso aperture.

In at least one embodiment of the present disclosure, the method may further comprise obtaining at least vital sign of the infant with the first medical device. The at least vital sign of the infant may include at least one of heat rate, respiration rate and temperature.

In at least one embodiment of the present disclosure, the method may further comprise providing medical treatment to the infant with the first medical device. The medical treatment may comprise administering a fluid to the infant, which may be performed intravenously.

In at least one embodiment of the present disclosure, the method may further comprise at least partially covering the anterior torso aperture or posterior torso aperture with a portion of the infant clothing pod at least one of before, during and after placing the first medical device through the anterior torso aperture or posterior torso aperture.

In at least one embodiment of the present disclosure, the method may further comprise the infant pod having the anterior torso aperture; placing the first medical device through the anterior torso aperture; and obtaining at least one vital sign of the infant with the first medical device and/or providing medical treatment to the infant with the first medical device.

In at least one embodiment of the present disclosure, the method may further comprise the infant pod having the posterior torso aperture; placing the first medical device through the posterior torso aperture; obtaining at least one vital sign of the infant with the first medical device and/or providing medical treatment to the infant with the first medical device.

In at least one embodiment of the present disclosure, the method may further comprise the infant pod having at least one of a sub-anterior torso aperture and a sub-posterior torso aperture; placing the first medical device or a second medical device through the anterior torso aperture or posterior torso aperture, particularly providing medical treatment to the infant with the first medical device or the second medical device. The medical treatment may comprise administering a fluid to the infant, which may be performed intravenously.

In at least one embodiment of the present disclosure, the method may further comprise the infant including a first diaper on the infant; arranging the infant ingress-egress aperture such that the infant ingress-egress aperture has an open portion below the torso and closed portion overlying the torso; removing the first diaper from the infant through the open portion of the infant ingress-egress aperture; and placing a second diaper on the infant through the open portion of the infant ingress-egress aperture.

FIGURES

The above-mentioned and other features of this disclosure, and the manner of attaining them, will become more apparent and better understood by reference to the following description of embodiments described herein taken in conjunction with the accompanying drawings, wherein.

DETAILED DESCRIPTION

Figure 2:
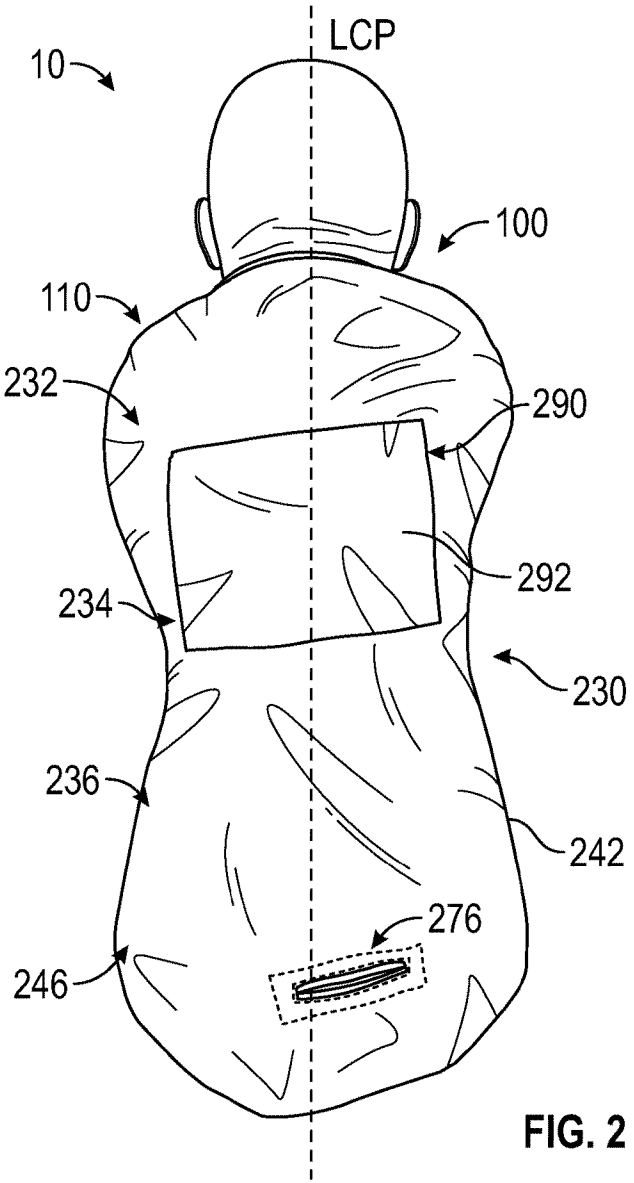
FIG. 2 is a rear (posterior) side view of the infant pod of FIG. 1.

It may be appreciated that the present disclosure is not limited in its application to the details of construction and the arrangement of components set forth in the following description or illustrated in the drawings. The invention(s) herein may be capable of other embodiments and of being practiced or being carried out in various ways. Also, it may be appreciated that the phraseology and terminology used herein is for the purpose of description and should not be regarded as limiting as such may be understood by one of skill in the art.

As shown by FIGS. 1-4, there is shown an article of clothing 100 for a human infant, such as a human infant having an age of newborn (e.g. birth) to six months or less of age. More particularly the article of clothing 100 is for a human infant having an age of newborn to four months or less of age, and moreover having an age of newborn to two months or less of age, such as newborn to four weeks of age.

With regards to weight, the article of clothing 100 may be configured to contain a human infant having a birth weight in a range of 1 pound (lb.) to 11 pounds, and more particularly 2 pounds to 9 pounds, and even more particularly 4 pounds to 7 pounds. The article of clothing 100 may be one size fits all (i.e. may be configured to contain a human infant having a birth weight over the range of 1 pound (lb.) to 11 pounds), or may be provided with various sizes. For example, a small size may be configured to contain a human infant having a birth weight over a range of 1 pound (lbs.) to 3 pounds); a medium size may be configured to contain a human infant having a birth weight over a range of 3 pound (lbs.) to 7 pounds); a large size may be configured to contain a human infant having a birth weight over a range of 7 pound (lbs.) to 11 pounds).

Article of clothing 100 may comprise an infant (body) pod 110, configured as a one-piece body suit. Infant pod 110 may comprise a front (anterior) side body cover 130, configured to cover/overlie the anterior body side of an infant, particularly the torso and upper and lower appendages (left and right arms and legs, respectively), and a rear (posterior) side body cover 230, configured to cover/overlie the posterior body side of an infant, particularly the torso and upper and lower appendages (left and right arms and legs, respectively).

Front body cover 130 and rear body cover 230 include upper regions 132, 232 particularly configured to cover/overlie the upper torso (chest and shoulders) and upper appendages (left and right arms) of an infant; intermediate regions 134, 234 particularly configured to cover/overlie the intermediate torso (abdomen); and lower regions 136, 236 particularly configured to cover/overlie the lower torso (pelvis and hips) and lower appendages (left and right legs).

Front body cover 130 and rear body cover 230 may be permanently joined along a substantial length of their respective peripheries, particularly peripheral edge area 142, 242 by a mechanical fastener such as one or more rows of stitching forming a lap joint. When stitched together, the front body cover 130 and rear body cover 230 form a pod cavity 112, particularly having an upper region 114, an intermediate region 116 and a lower region 118. Upper region 114 is particularly configured to receive the upper torso (chest and shoulders) and upper appendages (left and right arms) of an infant, while intermediate region 116 is particularly configured to receive the abdomen and lower region 118 is particularly configured to receive the lower torso (pelvis and hips) and lower appendages (left and right legs). The upper region 114 and lower region 118 may be particularly sized larger (volume, diameter) than the intermediate region 116 such that the infant pod 110 has an hourglass shape. As shown, the infant pod 110 has no appendage (arm or leg) specific apertures, thus the appendages are fully contained within the infant pod 110.

Front body cover 130 may particularly include a front (anterior) main or base panel 146, while rear body cover 230 may particularly include a rear (posterior) main or base panel 246.

Front body cover 130 further includes an openable and closeable infant ingress/egress aperture 150, which may extend longitudinally from a neck end 152 of the aperture 150 adjacent a neck aperture 122 of the infant pod 110 to a foot end 154 in a foot region 124 of the front body cover 130/pod cavity 112, i.e. substantially a full length of the body from the neck to the foot.

As shown, ingress/egress aperture 150 extends longitudinally along the body length of the infant 10 and divides the front body cover 130 into left and right sections 130*a*, 130*b*, respectively (relative to the infant 10), as well as divides the front main/base panel 146 into left and right sections 146*a*, 146*b*, respectively. As also shown, the ingress/egress aperture 150 is positioned lateral of the longitudinal center plane LCP of the infant pod (which may be understood to be the median sagittal plane or midsagittal plane), which bisects the body vertically through the midline marked by the naval. As a result, the ingress/egress aperture 150 may be understood to be laterally off-center and divide the front main/base panel 146 into unequally sized left and right sections 146*a*, 146*b*.

Ingress/egress aperture 150 may be made readily openable and closeable along a length thereof, either a portion or full length, by an openable and closeable mechanical closure 160. Mechanical closure 160 may particularly be a hook and loop fastener or a zipper fastener, such as a two-way (double separating) zipper fastener. With the foregoing mechanical closures 160, the infant ingress/egress aperture 150 may be openable simultaneously at both the neck end 152 and foot end 154, or opened at only one of ends 152, 154.

The front body cover right section 130*b*, and more particularly the front main/base panel right section 146*b*, further includes a front (anterior) torso aperture 166, which may be configured to overlie the ribcage of the infant 10 in a region of the heart and lungs. As shown, when the front main/base panel right section 146*b* is planar, the front torso aperture 166 has a configuration of a horizontal elongated slot which orientated substantially transverse (perpendicular) to the longitudinal center plane LCP, within plus (+) or minus (−) 30 degrees, and more particularly plus (+) or minus (−) 20 degrees, and even more plus (+) or minus (−) 10 degrees. As shown, the front torso aperture 166 is perpendicular to the longitudinal center plane LCP. The torso aperture 166 may have a length in a range of 1 to 8 inches, and more particularly in a range of 2 to 6 inches.

The front torso aperture 166 may be reinforced on an inner side of the front main/base panel right section 146*b* by a rectangular picture frame reinforcement member 168 having a reinforcement member aperture 170 which is aligned with the front torso aperture 166 of the front main/base panel right section 146*b* of the front body cover right section 130*b*. Each of the four sides of the reinforcement member 168 may be permanently joined to the front main/base panel right section 146*b* by a mechanical fastener such as one or more rows of stitching forming a lap joint.

The front body cover right section 130*b*, and more particularly the front main/base panel right section 146*b*, further includes a front (anterior) sub-torso aperture 176, which may be configured to be positioned below the pelvis in a region between the left and right appendages (legs) when the appendages diverge. As shown, when the front main/base panel right section 146*b* is planar, the front sub-torso aperture 176 has a configuration of a horizontal elongated slot which orientated substantially transverse (perpendicular) to the longitudinal center plane LCP, within plus (+) or minus (−) 30 degrees, and more particularly plus (+) or minus (−) 20 degrees, and even more plus (+) or minus (−) 10 degrees. The sub-torso aperture 176 may have a length in a range of 1 to 4 inches, and more particularly in a range of 2 to 3 inches.

The front sub-torso aperture 176 may be reinforced on an inner side of the front main/base panel right section 146*b* by a rectangular picture frame reinforcement member 178 having a reinforcement member aperture 180 which is aligned with the sub-torso aperture 176 of the front main/base panel right section 146*b* of the front body cover right section 130*b*. Each of the four sides of the reinforcement member 180 may be permanently joined to the front main/base panel right section 146*b* by a mechanical fastener such as one or more rows of stitching forming a lap joint.

The front torso aperture 166 may be fully coverable by an overlying front torso aperture closure 190, which may particularly include a front (anterior) auxiliary or top panel 192 which overlies the right section 146*b* of front main/base panel 146.

As shown the front auxiliary/top panel 192 may have a shape of a polygon, such as being rectangular, and be joined to the right section 146*b* of front main/base panel 146 along at least a portion of the periphery thereof, particularly each one or more of peripheral edge areas 194*a*, 194*b*, 194*c* and/or 194*d* by at least one mechanical fastener.

For example, a substantial length of the horizontal upper peripheral edge area 194*a* may be joined to the right section 146*b* of front main/base panel 146 with a mechanical fastener, such as a permanent mechanical fastener being provided by one or more rows of stitching forming a lap joint. As used herein, a permanent mechanical fastener may be understood as a mechanical fastener that does not lend itself to be readily separable without damaging (e.g. breaking) itself or other portion of the article of clothing 10 being mechanically joined, such as the front auxiliary/top panel 192 and the front main/base panel 146.

A substantial length of the vertical left and right peripheral edge areas 194*b*, 194*c* may be joined to the right section 146*b* of front main/base panel 146 with at least one mechanical fastener 196, such as a refastenable (i.e. fastenable-unfastenable) mechanical fastener being provided by at least one elongated hook and loop fastener 196 (e.g. VELCRO brand hook and lock fastener). In such instance, the hook portion of the fastener 196 itself may be permanently fastened to the right section 146*b* of front main/base panel 146, such as by one or more rows of stitching forming a lap joint, while the loop portion of the fastener 196 itself may be permanently fastened to the vertical left and right peripheral edge areas 194*b*, 194*c* of the front auxiliary/top panel 192. In certain embodiments, the loop portion of the fastener 196 may be eliminated, and the front auxiliary/top panel 192 itself may be fastened directly to the hook portion of the fastener 196 located on the front main/base panel 146.

With the foregoing construction, article of clothing 100, and more particularly infant pod 110, may be used to keep an infant warm while administering medical monitoring and/or treatment to the anterior of the infant.

Figure 1:
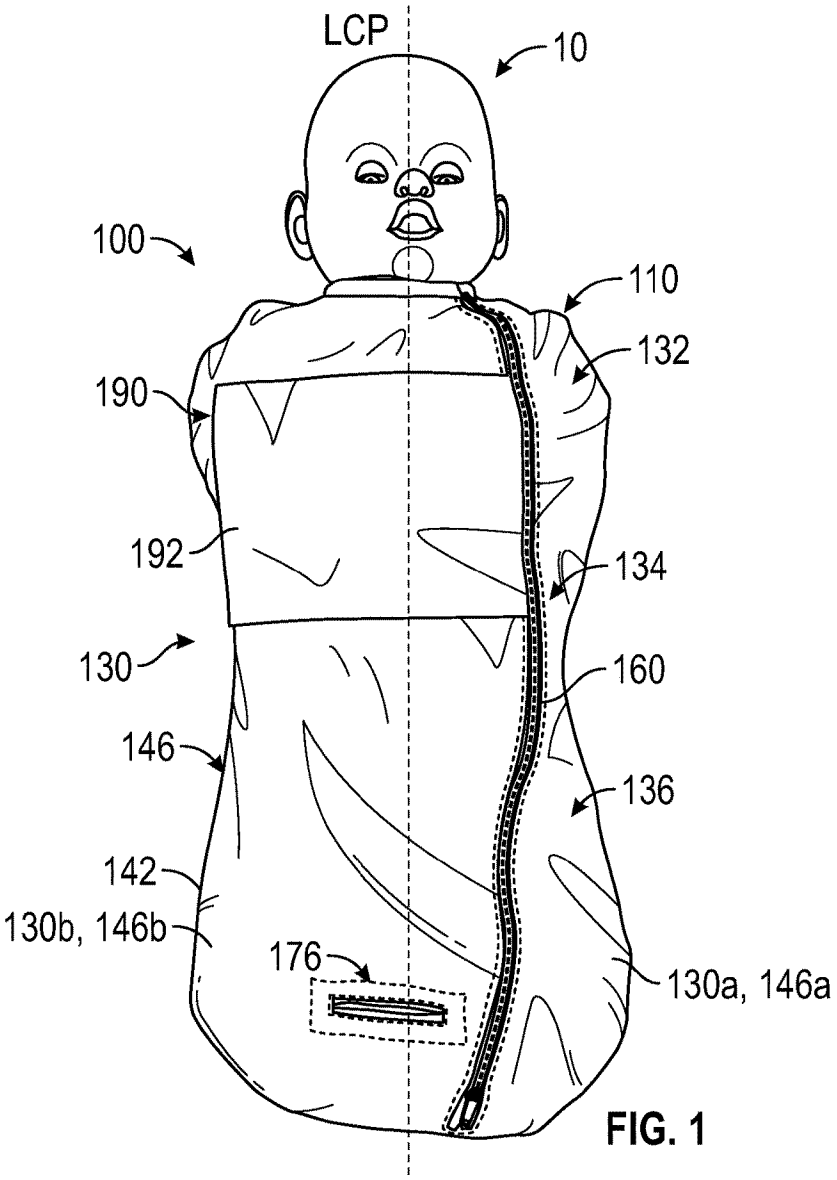
FIG. 1 is a front (anterior) side view of an infant pod according to the present disclosure containing an infant.
Figure 4:
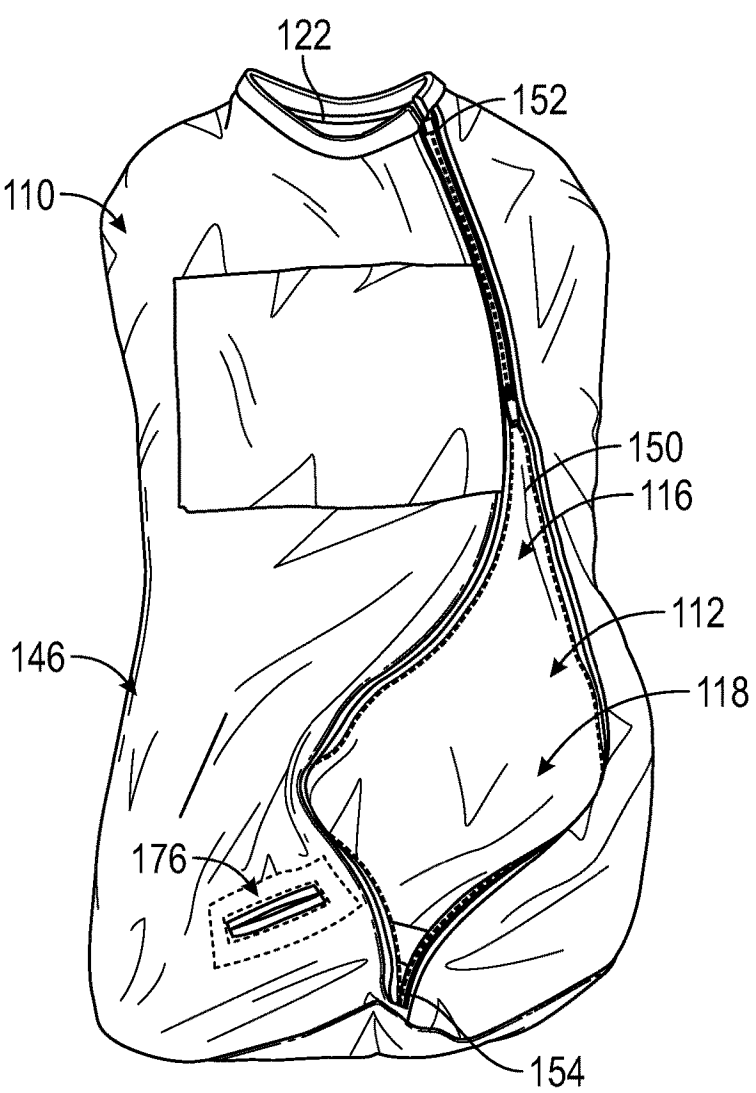
FIG. 4 is front (anterior) side view of the infant pod of FIG. 1 with the ingress/egress aperture open from the foot end of the lower appendage to approximately the ribcage of the torso.
Figure 3:
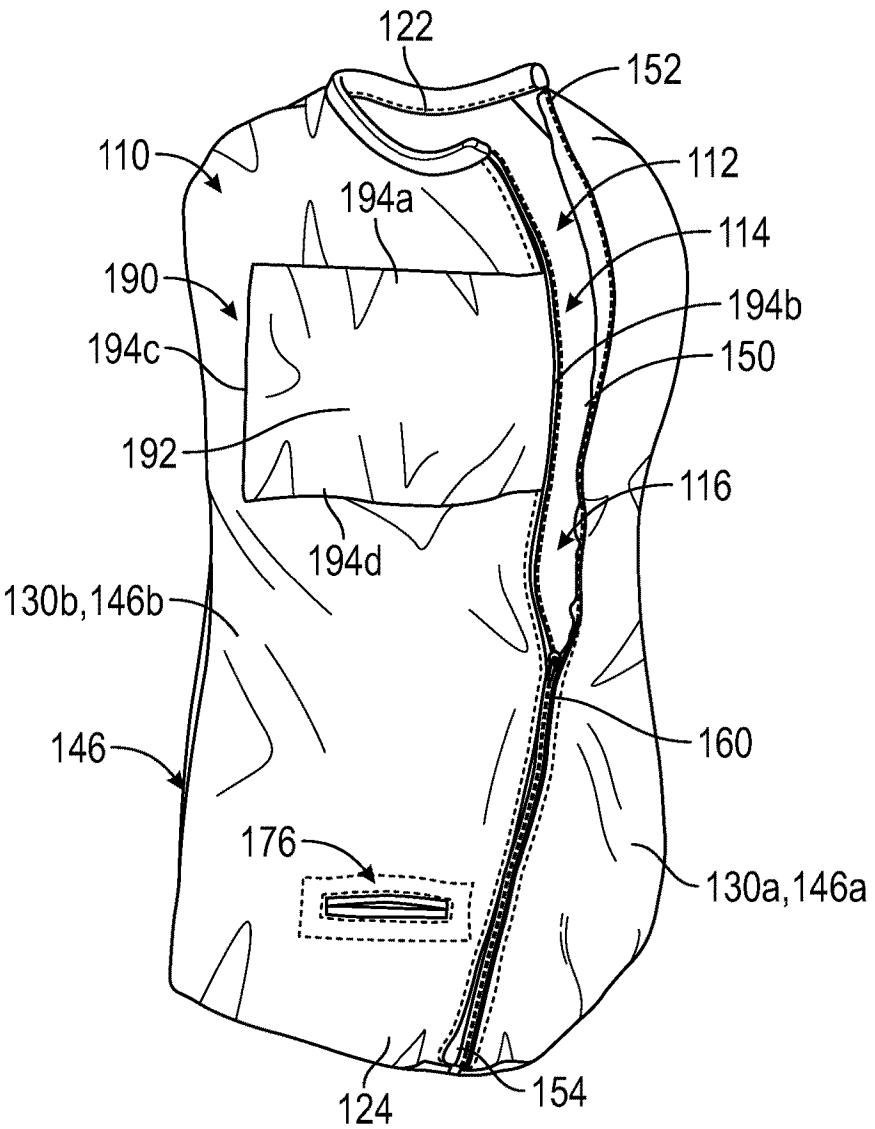
FIG. 3 is front (anterior) side view of the infant pod of FIG. 1 with the ingress/egress aperture open from the neck end to approximately the waistline of the torso.

As shown in FIGS. 1 and 3, when arranged over front main/base panel 146, front torso aperture closure 190, and more particularly, front auxiliary/top panel 192 may be used to cover front torso aperture 166 to better keep the infant warm.

Figure 5:
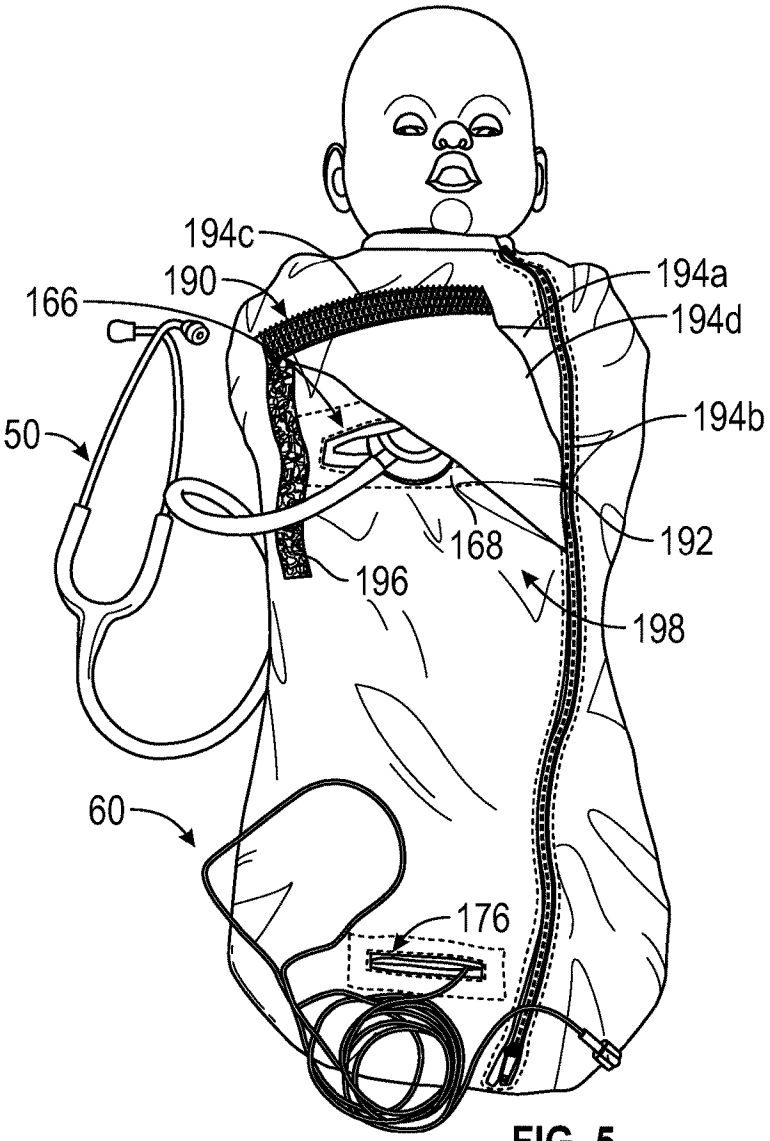
FIG. 5 is front (anterior) side view of the infant pod of FIG. 1 with medical devices, particularly a diagnostic device (stethoscope) and a treatment device (intravenous tubing).
Figure 8:
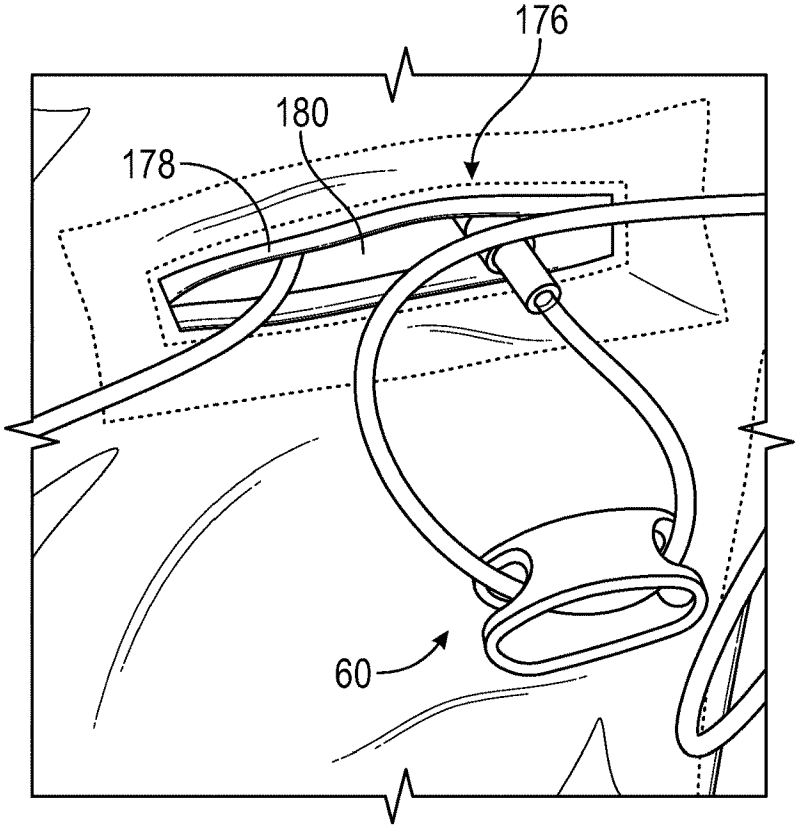
FIG. 8 is a close-up front (anterior) side view of the infant pod of FIG. 1 with the treatment device of FIG. 5.
Figure 7:
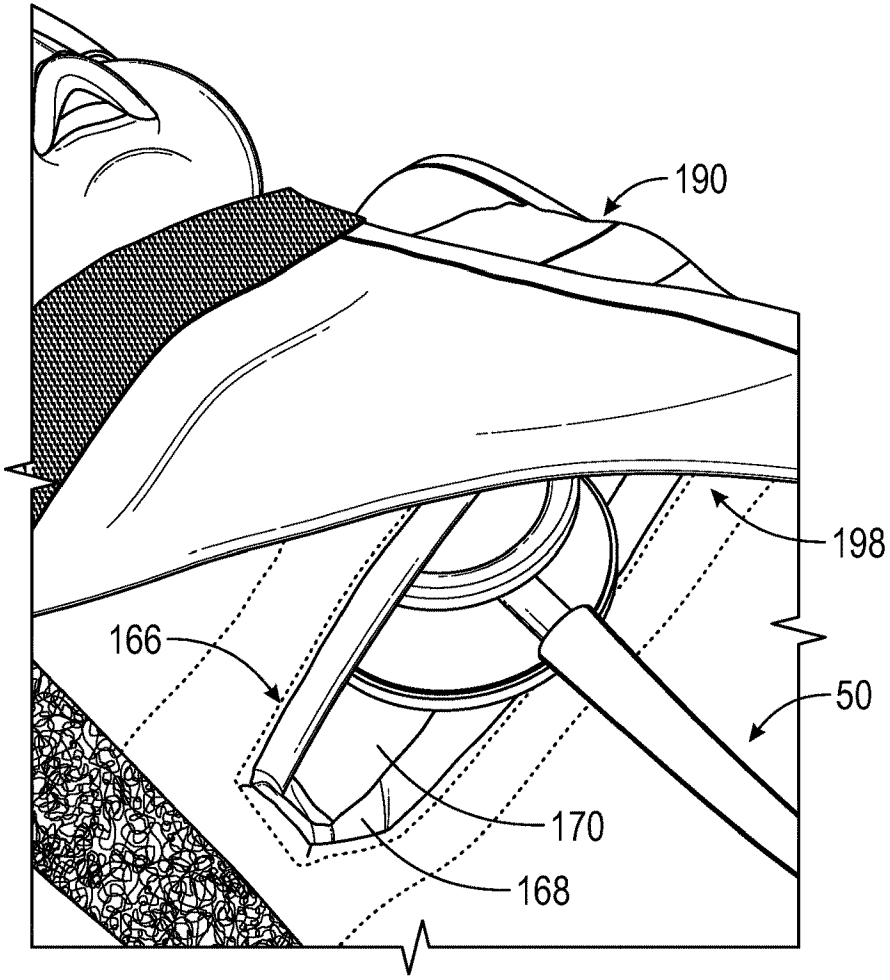
FIG. 7 is a close-up front (anterior) side view of the infant pod of FIG. 1 with the diagnostic device of FIG. 5.

Referring now to FIGS. 5 and 7, as shown a medical device 50, particularly a medical diagnostic device in the form of a stethoscope, is shown extending through front torso aperture 166 into pod cavity 112 occupied by infant 10. As shown, the location of the front torso aperture 166 makes it possible to use the stethoscope to monitor blood circulatory and/or respiratory activity of the infant 10, particularly by listening to the heart beat and lungs, respectively. Similarly, as shown in FIGS. 5 and 8, a medical device 60, particularly a medical therapeutic device in the form of an intravenous kit, is shown extending through front sub-torso aperture 176 into pod cavity 112 occupied by infant 10, were it may be connected to the infant in a known manner, particularly to the foot, to deliver medication to the infant from an intravenous fluid source.

As shown in FIGS. 5 and 7, the refastenable mechanical fastener 196 along right peripheral edge area 194*c* of the front auxiliary/top panel 192 has been detached such that the front auxiliary/top panel 192 may be folded diagonally to provide visual access to front torso aperture 166, particularly for inserting medical device 50 into and through front torso aperture 166 and positioning medical device 50 on (adjacent) infant 10.

In other embodiments, the refastenable mechanical fastener 196 along right peripheral edge area 194*c* of the front auxiliary/top panel 192 may remain fastened or subsequently unfastened and refastened, along with the mechanical fasteners along upper peripheral edge area 194*a* and left peripheral edge area 194*b*, while medical device 50 is inserted into and through front torso aperture 166 and positioned on infant 10. In such situation, a three-sided closed-pocket 198 may be formed into which medical device 50 may be inserted (or removed) through the opening between the front auxiliary/top panel 192 and the front main/base panel 146 along the lower peripheral edge area 194*d* of the front auxiliary/top panel 192.

It may be desirable that no fastener is provided along the lower peripheral edge area 194*d* of the front auxiliary/top panel 192 or the portion of front main/base panel 146 underlying such, so that access to pocket 198, and more particularly front torso aperture 166, is never completely impeded from immediate access.

It may be desirable such that refastenable mechanical fasteners 196 are use along both of the vertical left and right peripheral edge areas 194*b*, 194*c* of the front auxiliary/top panel 192 such that both fasteners may be detached and the front auxiliary/top panel 192 rolled up like a shade. However, in such case the permanent fastener 196 along horizontal upper peripheral edge area 194*a* of the front auxiliary/top panel 192 prevents the front auxiliary/top panel 192 from being completely detached and potentially lost.

In other embodiments, it should be understood that joining peripheral edge areas 194*a*, 194*b*, 194*c* and/or 194*d* of front auxiliary/top panel 192 to front main/base panel 146 may be performed with any combination of fasteners, whether permanent (single-use) or temporary (multiple-use) as suitable.

For example, with regards to permanent fasteners, such may be used along any combination of up to three of peripheral edge areas 194*a*, 194*b*, 194*c* and/or 194*d*, with the remaining peripheral edge area not having a permanent fastener, such as either a refastenable fastener or no fastener). Conversely, with regards to refastenable fasteners, such may be used along any combination of up to four of peripheral edge areas 194*a*, 194*b*, 194*c* and/or 194*d*, in which case the front auxiliary/top panel 192 would be completely removable from and replaceable on the front main/base panel 146.

Figure 6:
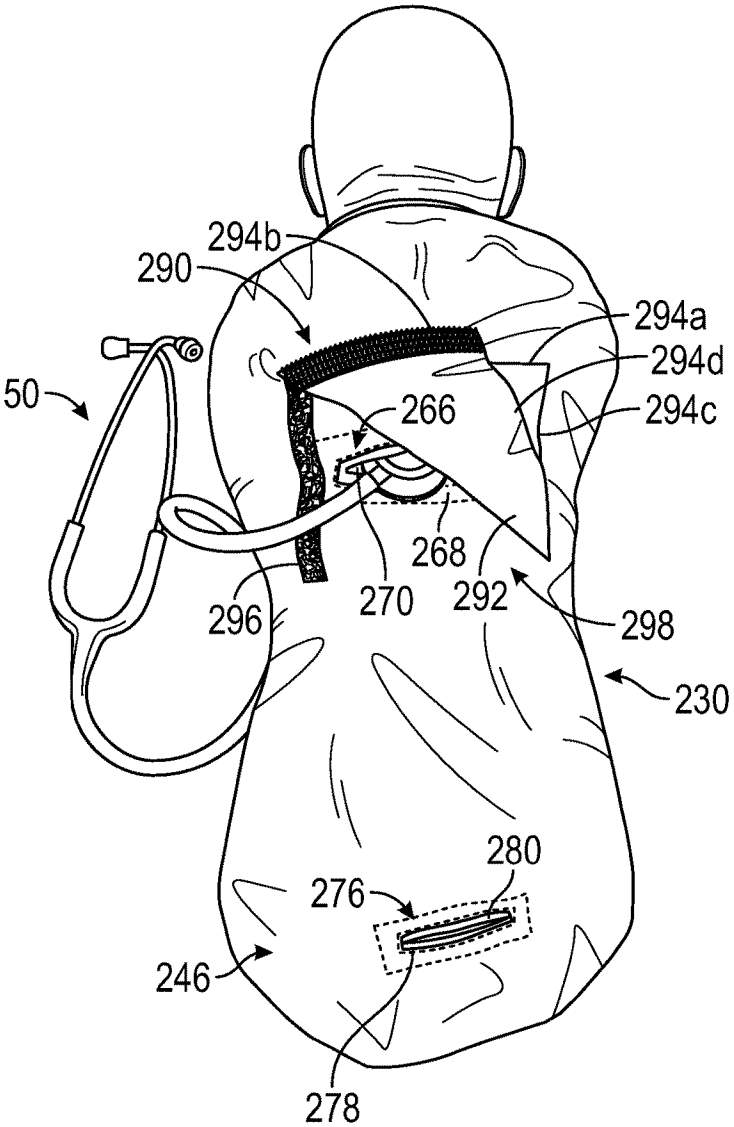
FIG. 6 is rear (posterior) side view of the infant pod of FIG. 1 with medical device, particularly a diagnostic device (stethoscope)

As shown by FIG. 6, the rear (posterior side) body cover 230, and more particularly the rear (posterior) main/base panel 246, includes a rear (posterior) torso aperture 266, which may be configured to overlie the spine of the infant 10 in a region of the heart and lungs. As shown, when the rear (posterior) main/base panel 246 is planar, the rear torso aperture 266 has a configuration of a horizontal elongated slot which orientated substantially transverse (perpendicular) to the longitudinal center LCP, within plus (+) or minus (−) 30 degrees, and more particularly plus (+) or minus (−) 20 degrees, and even more plus (+) or minus (−) 10 degrees.

Similar to the front torso aperture 166, rear torso aperture 266 may be reinforced on an inner side of the rear main/base panel 246 by a rectangular picture frame reinforcement member 268 having a reinforcement member aperture 270 which is aligned with the rear torso aperture 266 of the rear main/base panel 246 of the rear body cover 230. Similar to reinforcement member 168, each of the four sides of the reinforcement member 268 may be permanently fastened to the rear main/base panel 246 by a mechanical fastener such as one or more rows of stitching forming a lap joint.

The rear body cover 230, and more particularly the rear main/base panel 246, further includes a rear (posterior) sub-torso aperture 276, which may be configured to be positioned below the pelvis in a region between the left and right appendages (legs). As shown, when the rear main/base panel 246 is planar, the rear sub-torso aperture 276 has a configuration of a horizontal elongated slot which orientated substantially transverse (perpendicular) to the longitudinal center plane LCP, within plus (+) or minus (−) 30 degrees, and more particularly plus (+) or minus (−) 20 degrees, and even more plus (+) or minus (−) 10 degrees. As shown, the rear (posterior) sub-torso aperture 276 may be aligned with the front (anterior) sub-torso aperture 176 such that a harness strap 84 or other article may be passed through both apertures 176, 276 without binding.

Similar to front sub-torso aperture 176, rear sub-torso aperture 276 may be reinforced on an inner side of the rear main/base 246 by a rectangular picture frame reinforcement member 278 having a reinforcement member aperture 280 which is aligned with the sub-torso aperture 276 of the rear main/base panel right 246 of the rear body cover 230. Similar to reinforcement member 180, each of the four sides of the reinforcement member 280 may be permanently fastened to the rear main/base panel 246 by a mechanical fastener such as one or more rows of stitching to form a lap joint.

The rear torso aperture 266 may be fully coverable by an overlying rear torso aperture closure 290, which may particularly include a rear (posterior) auxiliary or top panel 292 which overlies the rear main/base panel 246.

In such regards, similar to the front auxiliary/top panel 192, rear auxiliary/top panel 292 may have a shape of a polygon, such as being rectangular, and be joined to the rear main/base panel 246 along at least a portion of periphery thereof, particularly one or more of peripheral edge areas 294*a*, 294*b*, 294*c* and/or 294*d* by at least one mechanical fastener.

For example, a substantial length of the horizontal upper peripheral edge area 294*a* may be joined to the rear main/base panel 246 with a mechanical fastener, such as a permanent mechanical fastener being provided by one or more rows of stitching forming a lap joint.

More particularly, a substantial length of the vertical left and right peripheral edge areas 294*b*, 294*c* may be joined to the rear main/base panel 246 with at least one mechanical fastener 296, such as a refastenable (i.e. fastenable-unfastenable) mechanical fastener being provided by at least one elongated hook and loop fastener 296 (e.g. VELCRO brand hook and lock fastener). In such instance, the hook portion of the fastener 296 itself may be permanently fastened to the rear main/base panel 246, such as by one or more rows of stitching forming a lap joint, while the loop portion of the fastener 296 itself may be permanently fastened to the vertical left and right peripheral edge areas 294*b*, 294*c* of the rear auxiliary/top panel 292. In certain embodiments, the loop portion of the fastener 296 may be eliminated, and the rear auxiliary/top panel 292 itself may be fastened directly to the hook portion of the fastener 296 located on the rear main/base panel 246.

Again, with the foregoing construction, article of clothing 100, and more particularly infant pod 110, may be used to keep an infant warm while administering medical monitoring and/or treatment to the posterior of the infant.

As shown in FIG. 2, when arranged over rear main/base panel 246, rear torso aperture closure 290, and more particularly, rear auxiliary/top panel 292 may be used to cover front torso aperture 266 to better keep the infant warm.

Referring now to FIG. 6, as shown a medical device 50, particularly a medical diagnostic device in the form of a stethoscope, is shown extending through rear torso aperture 266 into pod cavity 112 occupied by infant 10. As shown, the location of the rear torso aperture 266 makes it possible to use the stethoscope to monitor respiratory activity of the infant 10, particularly by listening to the lungs. Similarly, a medical device 60, particularly a medical therapeutic device in the form of an intravenous kit, may be extended through rear sub-torso aperture 276 into pod cavity 112 occupied by infant 10, were it may be connected to the infant in a known manner, particularly to the foot, to deliver medication to the infant from an intravenous fluid source.

As shown in FIG. 6, the refastenable mechanical fastener 296 along left peripheral edge area 294*b* of the rear auxiliary/top panel 292 has been detached such that the rear auxiliary/top panel 292 may be folded diagonally to provide visual access to rear torso aperture 266, particularly for inserting medical device 50 into and through rear torso aperture 126 and positioning medical device 50 on (adjacent) infant 10.

In other embodiments, the refastenable mechanical fastener 296 along left peripheral edge area 294*b* of the rear auxiliary/top panel 292 may remain fastened or subsequently unfastened and refastened, along with the mechanical fasteners along upper peripheral edge area 294*a* and right peripheral edge area 294*c*, while medical device 50 is inserted into and through front torso aperture 266 and positioned on infant 10. In such situation, a three-sided closed-pocket 298 may be formed into which medical device 50 may be inserted (or removed) through the opening between the rear auxiliary/top panel 292 and the front main/base panel 146 along the lower peripheral edge area 294*d* of the rear auxiliary/top panel 292.

It may be desirable that no fastener is provided along the lower peripheral edge area 294*d* of the rear auxiliary/top panel 292 or the portion of rear main/base panel 246 underlying such, so that access to pocket 298, and more particularly rear torso aperture 266, is never completely impeded from immediate access.

It may be desirable such that refastenable mechanical fasteners 296 are use along both of the vertical left and right peripheral edge areas 294*b*, 294*c* of the rear auxiliary/top panel 292 such that both fasteners may be detached and the front auxiliary/top panel 292 rolled up like a shade. However, in such case the permanent fastener 296 along horizontal upper peripheral edge area 294*a* of the rear auxiliary/top panel 292 prevents the rear auxiliary/top panel 292 from being completely detached and potentially lost.

In other embodiments, it should be understood that joining peripheral edge areas 294*a*, 294*b*, 294*c* and/or 294*d* of rear auxiliary/top panel 292 to rear main/base panel 246 may be performed with any combination of fasteners, whether permanent single-use) or temporary (multiple-use) as suitable.

For example, with regards to permanent fasteners, such may be used along any combination of up to three of peripheral edge areas 294*a*, 294*b*, 294*c* and/or 294*d*, with the remaining peripheral edge area not having a permanent fastener (e.g. either a refastenable fastener or no fastener). Conversely, with regards to refastenable fasteners, such may be used along any combination of up to four of peripheral edge areas 294*a*, 294*b*, 294*c* and/or 294*d*, in which case the rear auxiliary/top panel 292 would be completely removable from the rear main/base panel 246.

Front (anterior) main or base panel 146 and a rear (posterior) main or base panel 246, as well as front auxiliary/top panel 192 and rear auxiliary/top panel 292 may preferably be formed of a textile structure (e.g. fabric, cloth) which may particularly be formed of a network of interlaced fibers (e.g. yarns), such as by weaving, knitting, crocheting, knotting and/or felting (e.g. woven fabric, knitted fabric, fleece). The textile fibers may be synthetic and/or natural, including organic, such as polyester, acrylic cotton and/or modal fibers.

In one embodiment, the front (anterior) main or base panel 146 and a rear (posterior) main or base panel 246 may have a woven weight/unit area of 5-9 oz. (ounces/square yard), and more particularly a fabric weight of 6-8 oz. (ounces/square yard). The as front auxiliary/top panel 192 and rear auxiliary/top panel 292 may have a knitted weight/unit length of 600-1,000 denier (grams/9,000 meters of material) and more particularly 700-900 denier.

The front (anterior) main or base panel 146 and a rear (posterior) main or base panel 246, as well as front auxiliary/top panel 192 and rear auxiliary/top panel 292 may be particularly formed of a textile structure to inhibit heat loss from the infant, which may occur by radiation, conduction, convection and/or evaporation. The front (anterior) main or base panel 146 and a rear (posterior) main or base panel 246, as well as front auxiliary/top panel 192 and rear auxiliary/top panel 292 may be formed of a textile structure to assist in maintaining infant body temperature in a range of 36.5 to 37.7° C. (i.e. normal temperature range for a neonate).

Figure 10:
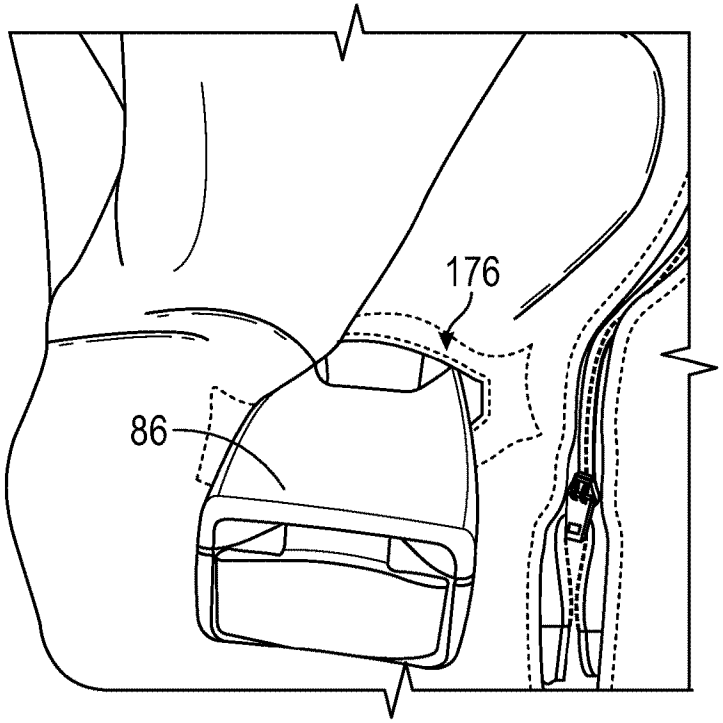
FIG. 10 is a front (anterior) side view of an infant pod of FIG. 1 with a seat buckle and strap extending through an aperture of the infant pod.
Figure 9:
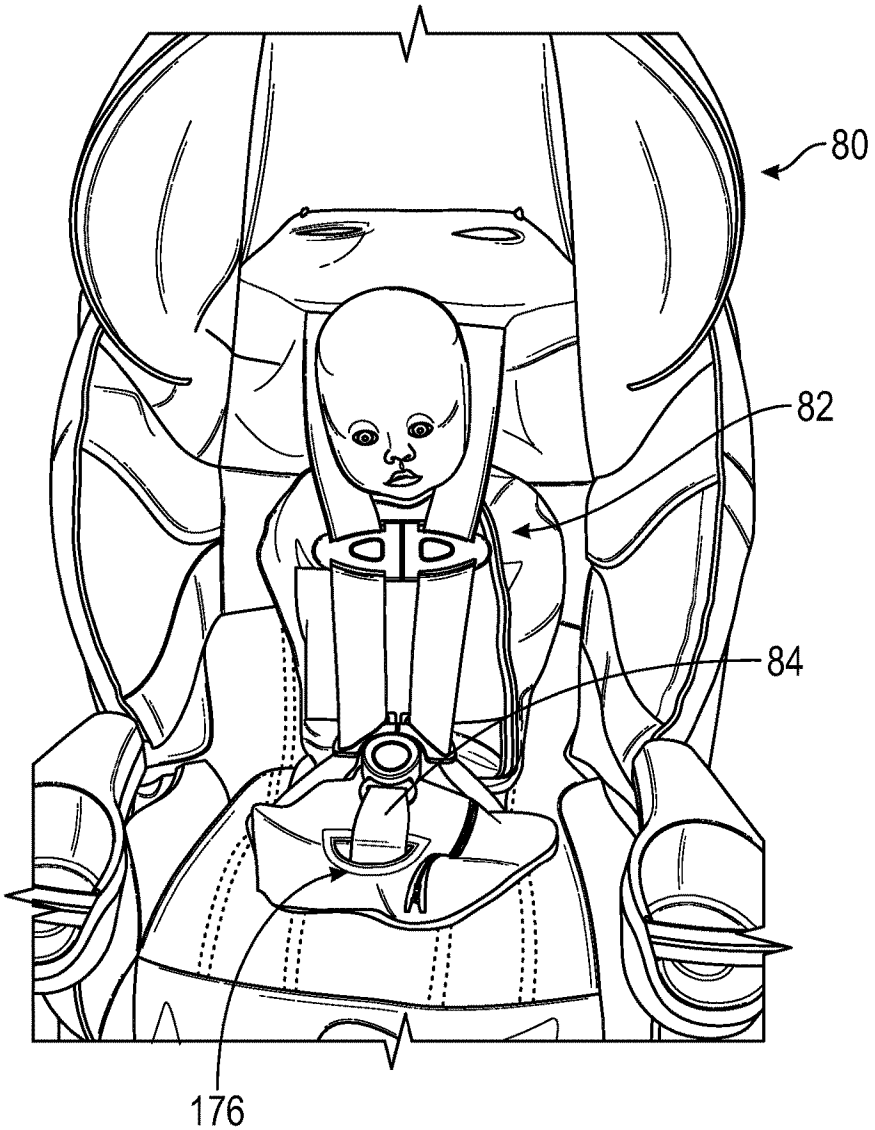
FIG. 9 is a front (anterior) side view of an infant pod of FIG. 1 being used with a seatbelt of a car seat.

Referring now to FIGS. 9 and 10, in addition to being useable for medical diagnostic and/or therapeutic treatment, the front sub-torso aperture 176 and rear sub-torso aperture 186 may be used to secure the infant to a child motor vehicle seat 80 which employs a seat harness 82 comprising a harness strap 84 and buckle 86 (e.g. buckle receiver) which extends through front sub-torso aperture 176 and rear sub-torso aperture 186 between the legs at the crotch, such as part of a multi-point (e.g. three-point or five point) harness.

Figure 12:
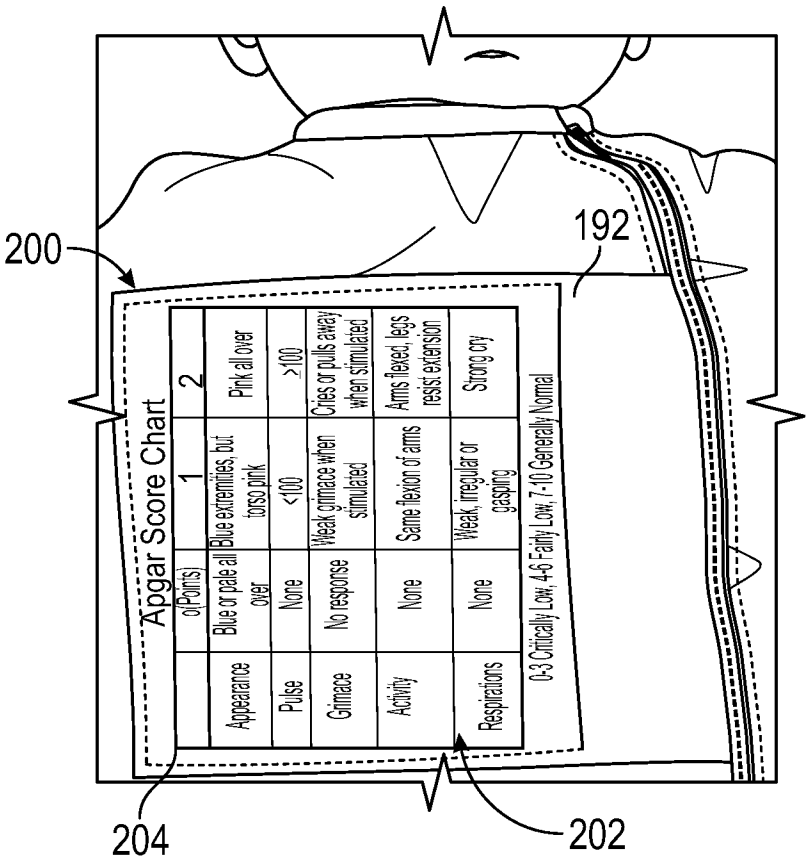
FIG. 12 is a front (anterior) side view of an infant pod of FIG. 1 with a medical information card.
Figure 11:
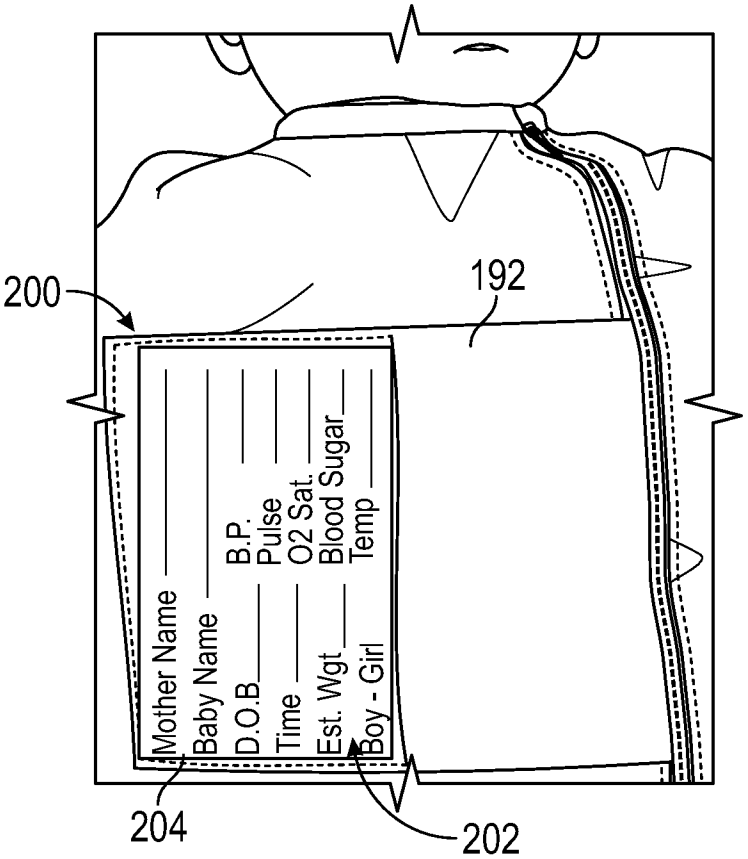
FIG. 11 is a front (anterior) side view of an infant pod of FIG. 1 with a medical information card.

In other embodiments, as shown in FIGS. 11-12, a transparent panel 200 may overlie the front auxiliary/top panel 192 and be fastened (e.g. stitched) thereto to form a clear (transparent) pocket 202. The pocket 202 may receive a medical information card 204 concerning the birth of the infant 10. As shown in FIG. 11, the information card 204 may include the mother name, baby name, date of birth, time of birth, estimated weight, blood pressure, pulse, oxygen saturation, blood sugar and temperature. As shown in FIG. 12, the information card 204 may also include an APGAR (Appearance, Pulse, Grimace, Activity, Respiration) score chart. Such information may be taken during a field birth and be given to a clinic upon receipt to the infant to more quickly evaluate the condition of the infant.

Figure 13:
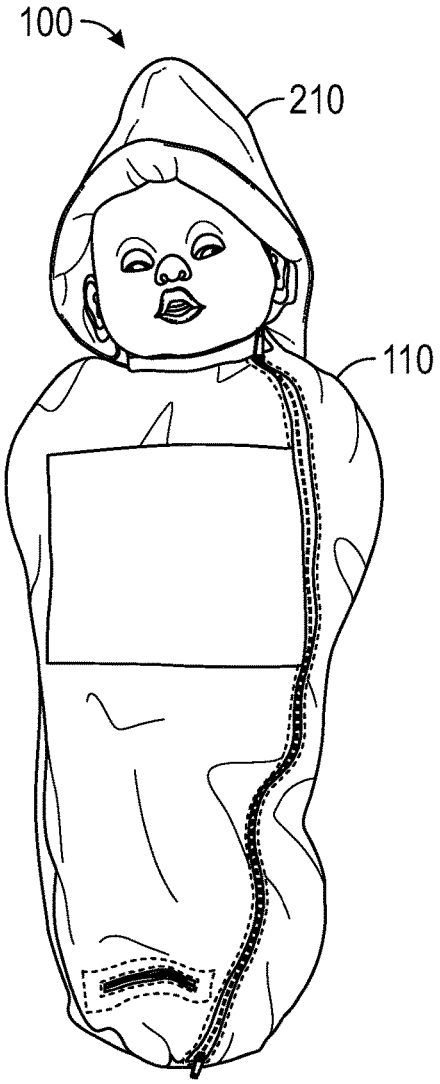
FIG. 13 is a front (anterior) side view of an infant pod of FIG. 1 with a head covering (hood) attached to the pod.
Figure 14:
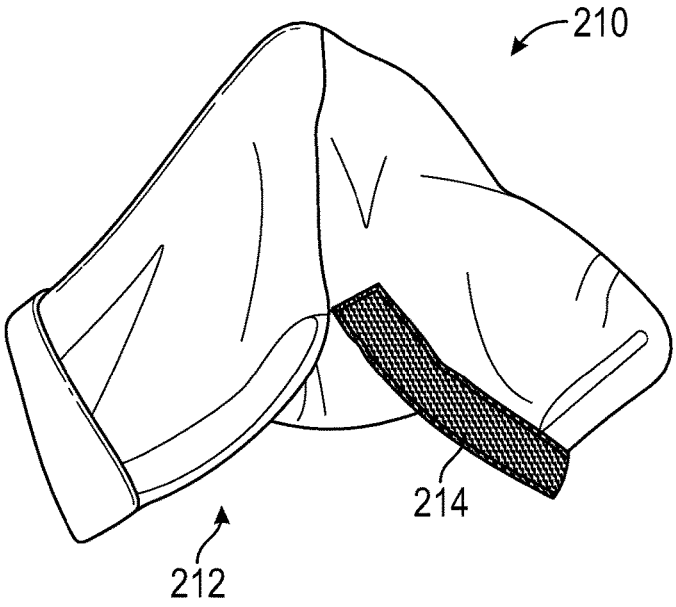
FIG. 14 is a first close-up view of the head covering of FIG. 13.
Figure 15:
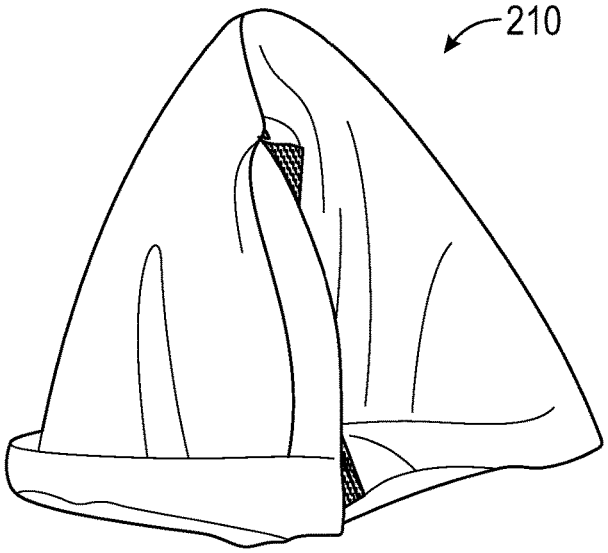
FIG. 15 is a second close-up view of the head covering of FIG. 13.

Referring now to FIGS. 13-15, FIG. 13 shows the article of clothing 100 comprising the infant pod 110 and an infant head covering 210, particularly in the form of a hood. Infant pod 110 and infant head covering 210 may be joined with at least one mechanical fastener, such as a refastenable (i.e. fastenable-unfastenable) mechanical fastener being provided by at least one elongated hook and loop fastener (e.g. VELCRO brand hook and lock fastener), which is not shown, but similar to fastener 196.

As shown in FIGS. 14-15, infant head covering 210 may be made size adjustable with vertical adjustment slot 212 configured to make a diameter of the head covering 210 adjustable. Such may be made adjustable at least one mechanical fastener 214, such as a refastenable (i.e. fastenable-unfastenable) mechanical fastener being provided by at least one elongated hook and loop fastener (e.g. VELCRO brand hook and lock fastener).

Figure 16:
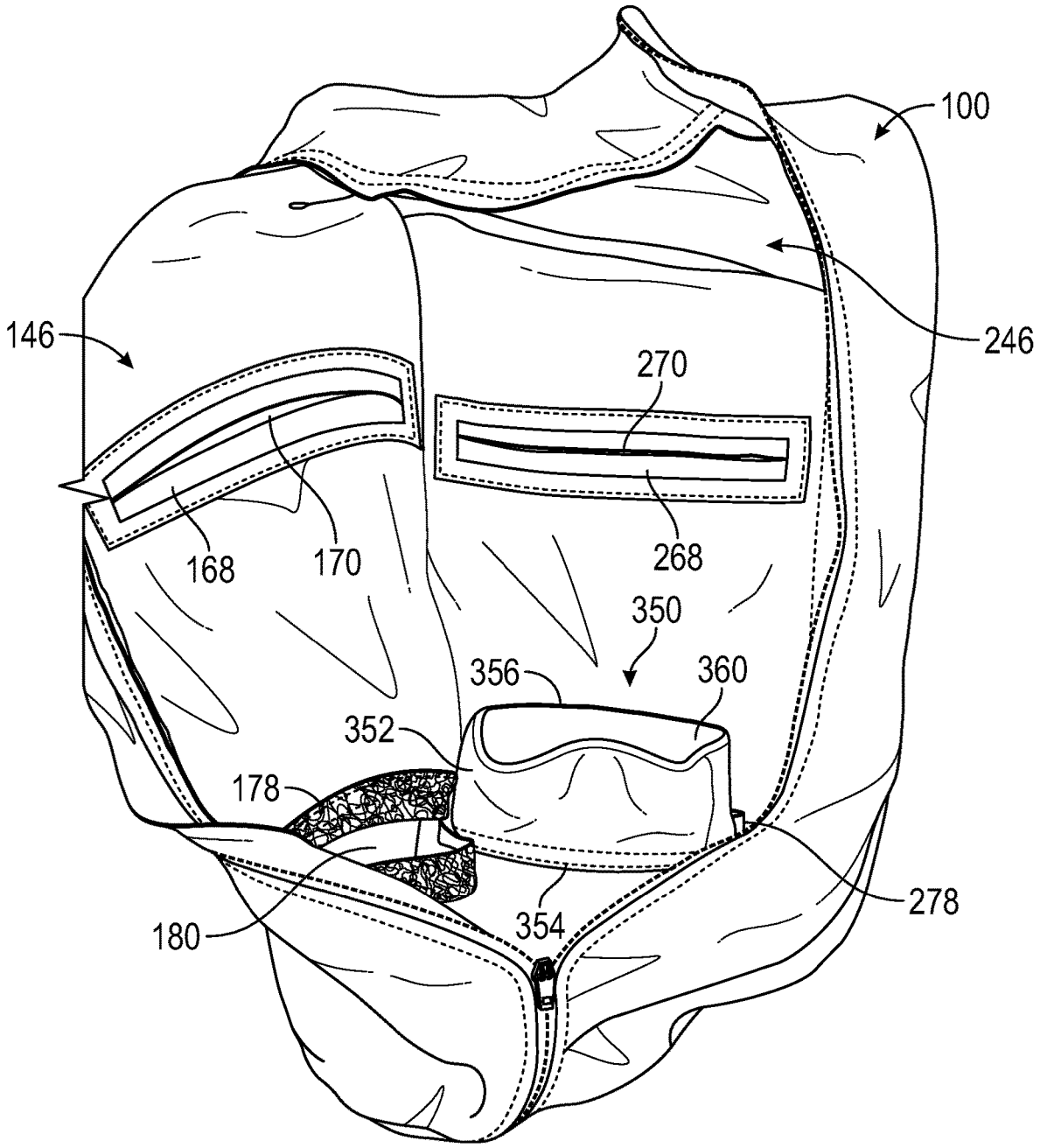
FIG. 16 is interior view of the infant pod of FIG. 1, with the ingress/egress aperture open from the neck end to approximately a foot end of the lower appendage.

Referring now to FIG. 16, the infant pod 110 is shown with the ingress/egress aperture 150 open from the neck end to approximately a foot end of the lower appendage, and including one tubular end 354 of a cylindrical tubular sleeve 350 permanently fastened to an inner side of the rear body cover 230, particularly by a mechanical fastener such as one or more rows of stitching extending through tubular end 354 of the tubular sleeve 350 and the rectangular picture frame reinforcement member 278 and/or the rear main/base panel 246. As shown the tubular sleeve 350 is fastened to the reinforcement member 278 such that the reinforcement member aperture 280 (e.g. see FIG. 6) of the reinforcement member 278 is aligned with the passage 360 of the tubular sleeve 350.

Figure 17:
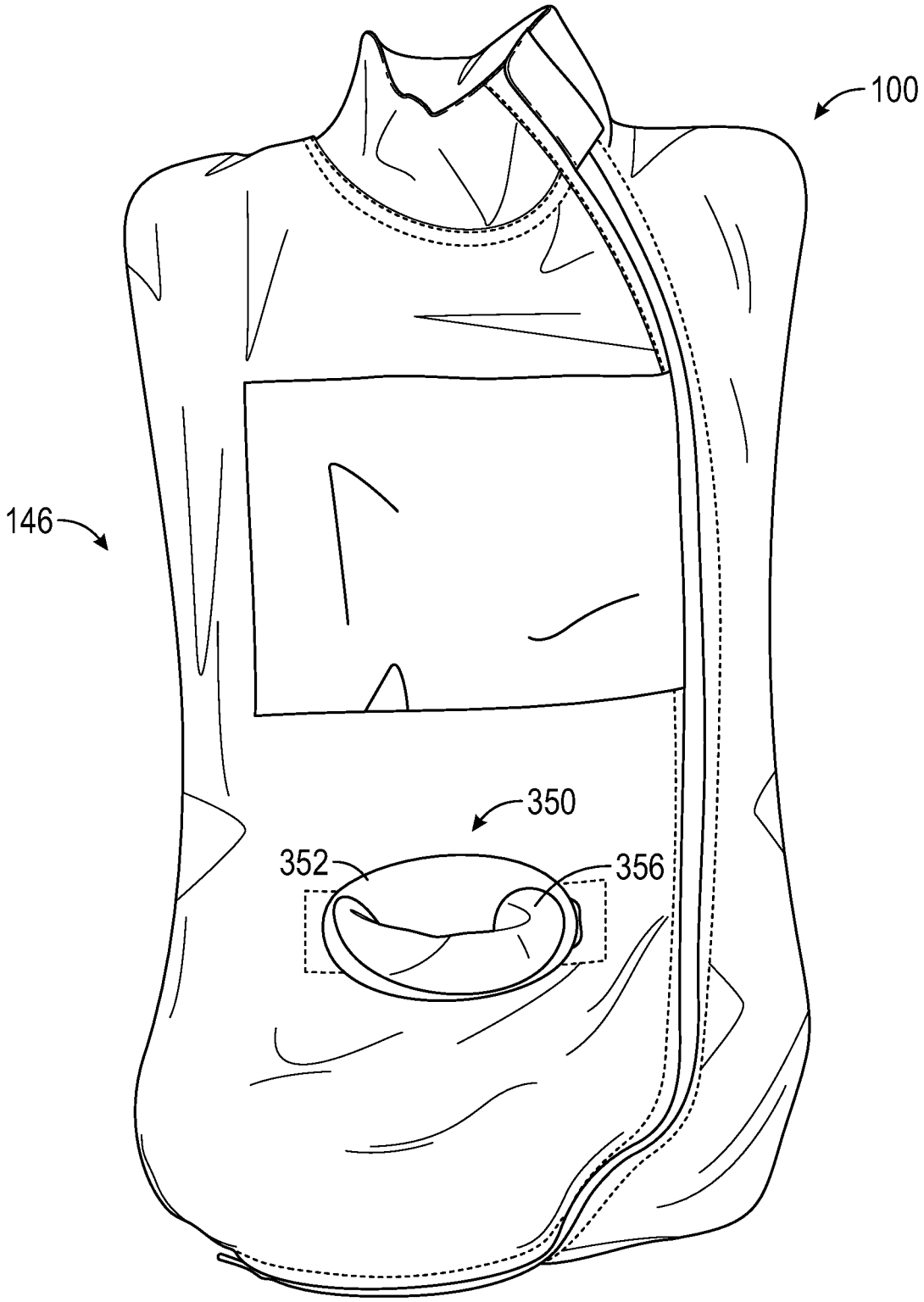
FIG. 17 is front (anterior) side view of the infant pod of FIG. 16 with the ingress/egress aperture fully closed.

Referring now to FIG. 17, during use, the unsecured end 356 of the tubular sleeve 350 may extend (be pulled or otherwise drawn) through the reinforcement member aperture 180 of reinforcement member 178 in the front body cover 130. Thereafter, the buckle 84 and harness strap 84 (e.g. see FIG. 9) may be extended through the reinforcement member aperture 280 of the reinforcement member 278, the passage 360 of the tubular sleeve 350 and the reinforcement member aperture 180 of reinforcement member 178. In the foregoing manner, the legs of the infant 10 are separated/isolated from the harness strap 84 by the tubular sleeve 350, which may inhibit chafing of the legs of the infant 10 against the harness strap 84.

While a preferred embodiment of the present invention(s) has been described, it should be understood that various changes, adaptations and modifications can be made therein without departing from the spirit of the invention(s) and the scope of the appended claims. The scope of the invention(s) should, therefore, be determined not with reference to the above description, but instead should be determined with reference to the appended claims along with their full scope of equivalents. Furthermore, it should be understood that the appended claims do not necessarily comprise the broadest scope of the invention(s) which the applicant is entitled to claim, or the only manner(s) in which the invention(s) may be claimed, or that all recited features are necessary.

LIST OF REFERENCE CHARACTERS

10 infant
60 medical device
50 medical device
80 vehicle seat
82 seat harness
84 vehicle seat harness trap
86 vehicle seat harness buckle
100 article of clothing
110 infant pod
112 pod cavity
114 upper region of cavity
116 intermediate region of cavity
118 lower region of cavity
122 neck aperture
124 foot region of cavity
130 front (anterior side) body cover
**130*a*** front cover left section
**130*b*** front cover right section
132 upper region front cover
134 intermediate region of front cover
136 lower region of front cover
142 front body cover peripheral edge area
146 front (anterior) main or base panel
**146*a*** front main/base panel left section
**146*b*** front main/base panel right section
150 infant ingress/egress aperture
152 neck end of infant ingress/egress aperture
154 foot end of infant ingress/egress aperture
160 mechanical closure
166 front (anterior) torso aperture
168 reinforcement member
170 reinforcement member aperture
176 front (anterior) sub-torso aperture
178 reinforcement member
180 reinforcement member aperture
190 front (anterior) torso aperture closure
192 front (anterior) auxiliary or top panel
**194*a*** upper peripheral edge area of front auxiliary/top panel
**194*b*** left peripheral edge area of front auxiliary/top panel
**194*c*** right peripheral edge area of front auxiliary/top panel
**194*d*** lower peripheral edge area of front auxiliary/top panel
**194*e*** front of the front auxiliary/top panel
196 fastener
198 pocket
200 transparent panel
202 transparent pocket
204 medical information card
210 infant head covering hood
212 adjustment slot
214 mechanical fastener
230 rear (posterior side) body cover

232 upper region rear cover
234 intermediate region of rear cover
236 lower region of rear cover
242 rear body cover peripheral edge area
246 rear (posterior) main or base panel
266 rear (posterior) torso aperture
268 reinforcement member
270 reinforcement member aperture
276 rear (posterior) sub-torso aperture
278 reinforcement member
280 reinforcement member aperture
290 rear (posterior) torso aperture closure
292 rear (posterior) auxiliary or top panel
294*a* upper peripheral edge area of rear auxiliary/top panel
294*b* left peripheral edge area of rear auxiliary/top panel
294*c* right peripheral edge area of rear auxiliary/top panel
294*d* lower peripheral edge area of rear auxiliary/top panel
296 fastener
298 pocket
350 tubular sleeve
352 tubular sleeve wall
354 tubular end
356 tubular end
360 tubular sleeve passage

What is claimed is:

1. An article of clothing, comprising:

an infant pod configured to contain an infant, the infant having a birth weight in a range of 1 pound to 11 pounds;

the infant pod having a cavity configured to contain upper appendages, lower appendages and a torso of the infant, wherein the infant pod has no appendage apertures or extensions for the upper appendages or the lower appendages of the infant whereby the upper appendages and the lower appendages cannot exit the cavity;

the infant pod having an openable and closeable infant ingress-egress aperture extending longitudinally along a length of the infant pod from a neck opening to a foot end;

the infant pod having an anterior torso aperture;

the infant pod comprises an anterior body cover with a left side and a right side, the anterior body cover including the ingress-egress aperture that extends between the left side and the right side;

the anterior body cover comprising an anterior base panel and an anterior top panel;

the anterior torso aperture is formed in the anterior base panel and coverable by the anterior top panel such that the anterior top panel overlies the anterior torso aperture;

the anterior top panel is joined to the anterior base panel such that, when the anterior top panel overlies the anterior torso aperture, a pocket is formed between the anterior base panel and the anterior top panel which provides access to the anterior torso aperture;

the pocket is accessible through an opening disposed between the anterior top panel and the anterior base panel along a lower peripheral edge area of the anterior top panel;

the infant pod has a longitudinal center;

the anterior torso aperture is disposed at opposing sides of the longitudinal center of the infant pod, and extends across the longitudinal center of the infant pod;

the ingress-egress aperture of the anterior body cover is laterally off-center of the longitudinal center of the infant pod and lateral of and spaced from the anterior torso aperture; and wherein the anterior top panel is joined to the anterior base panel by at least one fastener, wherein the at least one fastener comprises a permanent fastener.

2. The article of clothing of claim 1, wherein:

the ingress-egress aperture is openable and closeable by a zipper fastener.

3. The article of clothing of claim 2, wherein:

the zipper fastener is a two-way zipper fastener.

4. The article of clothing of claim 1, wherein: the at least one fastener comprises a mechanical fastener.

5. The article of clothing of claim 1, wherein: the at least one fastener comprises a multiple use fastener.

6. The article of clothing of claim 1, wherein: the permanent fastener comprises at least one row of stitches.

7. The article of clothing of claim 1, wherein:

the infant pod has a posterior torso aperture.

8. The article of clothing of claim 7, wherein:

the anterior torso aperture is arranged to overlie a chest of the infant and the posterior torso aperture is arranged to overlie a back of the infant.

9. The article of clothing of claim 1, wherein:

the infant pod has at least one of an anterior sub-torso aperture and a posterior sub-torso aperture.

10. The article of clothing of claim 9, wherein:

the infant pod has both the anterior sub-torso aperture and the posterior sub-torso aperture.

11. The article of clothing of claim 10, wherein:

the anterior sub-torso aperture and the posterior sub-torso aperture are arranged to be between the lower appendages of the infant when the lower appendages diverge.

12. The article of clothing of claim 1, wherein:

no fastener is disposed along the lower peripheral edge area of the anterior top panel.

13. The article of clothing of claim 1, wherein:

the anterior top panel comprises an upper peripheral edge area, a left peripheral edge area and a right peripheral edge area; and the anterior top panel is joined to the anterior base panel along at least one of the upper peripheral edge area, the left peripheral edge area and the right peripheral edge area.

14. The article of clothing of claim 13, wherein:

the anterior top panel is joined to the anterior base panel along the upper peripheral edge area by a multiple use fastener.

15. The article of clothing of claim 13, wherein:

the anterior top panel is joined to the anterior base panel along the left peripheral edge area by a permanent fastener.

16. The article of clothing of claim 13, wherein:

the anterior top panel is joined to the anterior base panel along the right peripheral edge area by a multiple use fastener.

17. The article of clothing of claim 1, wherein:

the anterior top panel includes a transparent pocket.

18. The article of clothing of claim 17, wherein:

the transparent pocket includes a medical information card.

19. The article of clothing of claim 15, wherein:

the permanent fastener comprises one or more rows of stitching.

20. The article of clothing of claim 16, wherein:

the multiple use fastener comprises a hook and loop fastener.

* * * * *